United States Patent [19]

Markwardt

[11] Patent Number: 4,835,854

[45] Date of Patent: Jun. 6, 1989

[54] CABLE SPLICING METHOD

[75] Inventor: Terrance L. Markwardt, Cedar Park, Tex.

[73] Assignee: Minnesota Mining and Manufacturing Company, St. Paul, Minn.

[21] Appl. No.: 152,457

[22] Filed: Feb. 5, 1988

[30] Foreign Application Priority Data

Feb. 20, 1987 [JP] Japan ..... 62-37719

[51] Int. Cl.[4] ..... H01R 43/00

[52] U.S. Cl. ..... 29/857; 174/84 S; 174/88 S; 439/369

[58] Field of Search ..... 29/857, 861, 863; 174/89 R, 84 G, 88 R, 88 S, 88 C; 439/284, 285, 287, 369, 449, 456, 492

[56] References Cited

U.S. PATENT DOCUMENTS 1,336,290 4/1920 Finkelstein ..... 174/84 S
2,267,630 12/1941 Weiland ..... 174/88 S X
3,551,879 12/1970 Waller, Sr. ..... 439/369

FOREIGN PATENT DOCUMENTS 213178 3/1924 United Kingdom ..... 174/84

*Primary Examiner*—Carl J. Arbes
*Attorney, Agent, or Firm*—Donald M. Sell; Walter N. Kirn; John C. Barnes

[57] ABSTRACT

Splices in multi-wire cables are orderly when wires of the same length, each affixed to a pluggable connector, are joined and the connectors are rotated 180 degrees to maintain the wire pairs orderly and are bundled.

2 Claims, 3 Drawing Sheets

CABLE SPLICING METHOD

BACKGROUND OF THE INVENTION

1. Field of the Invention

The present invention relates to a method of splicing two cables each containing a number of wires, and more particularly to a method of splicing two cables by cutting the wires of the respective cables to be of the same predetermined length.

2. Description of the Prior Art

In splicing two cables each containing a number wires, the wires of one cable are connected to the corresponding wires of the other cable through electrical connectors. First, two cables are prepared, and an outer sheath of required length is stripped off from the end of each cable. Corresponding wires of the respective cables are cut to be of a length dependent on the bank locations of the plural connectors between the two cables, and then connected to the relevant connectors. Finally, the connectors are bundled together.

According to the prior splicing method, the wires of the respective cables were required to be cut to a length dependent on a bank locations of the connectors between the cables, to which connectors are to be connected to the wires.

SUMMARY OF THE INVENTION

According to one aspect of the present invention, there is provided a wiring method comprising the steps of preparing two lengths of cables each containing a number of wires; removing the outer sheaths of the respective cable ends to expose free ends of the wires of a predetermined length; installing connectors on the free ends of the wires, whereby the connector installed on one cable end is pluggable with a corresponding connector installed on the other cable. The invention further includes the step of plugging the connector on one cable end with the connector on the other cable end; rotating the connectors 180 degrees and positioning the connectors in their proper bank locations; and bundling the connectors.

According to another aspect of the present invention, there is provided a wiring method using a plurality of connectors, the method comprising the steps of preparing a length of a first cable including exposing free ends of the wires of a predetermined length having installed thereon a plurality of connectors; removing an outer sheath of a cable end of a second cable to expose free ends of the wires of a predetermined length; installing a plurality of connectors pluggable with corresponding connectors installed on the first cable on the free ends of the wires of the second cable; plugging the connectors on the two cables together; rotating the connectors 180 degrees and positioning them in proper bank locations; and bundling the connectors.

DESCRIPTION OF THE PREFERRED EMBODIMENT

Figure 1:
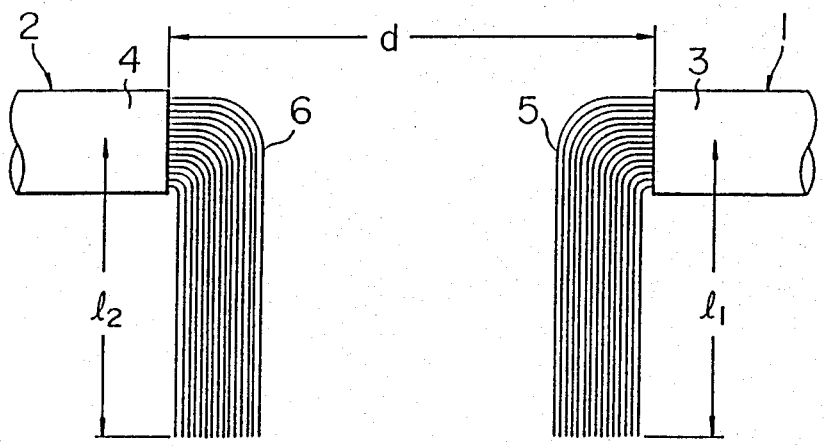
FIG. 1 is an illustration showing the state in which wires of two cables having their ends, from which respective outer sheaths are removed, are cut to be of a predetermined length.

Referring to FIG. 1, there are shown two cables sheaths 3, 4 are removed over a certain length so that a number of wires 5, 6, contained in the respective cables come into a free separate state. These cables each contain a plurality of units 7 and the number of wires 5, 6 are accommodated in the respective units 7.

Depending on the number of wire pairs of the cables to be spliced, the number of connectors 11, a distance (d) between the ends of the outer sheaths 3, 4 of the respective cables, and free lengths ($l_1$, $l_2$) of the respective wires are determined. For example, in case of the distance (d) between the ends of the outer sheaths 3, 4 equal to about 450 mm, the free lengths ($l_1$) and ($l_2$) of the wires are selected to be about 800 mm.

Figure 2:
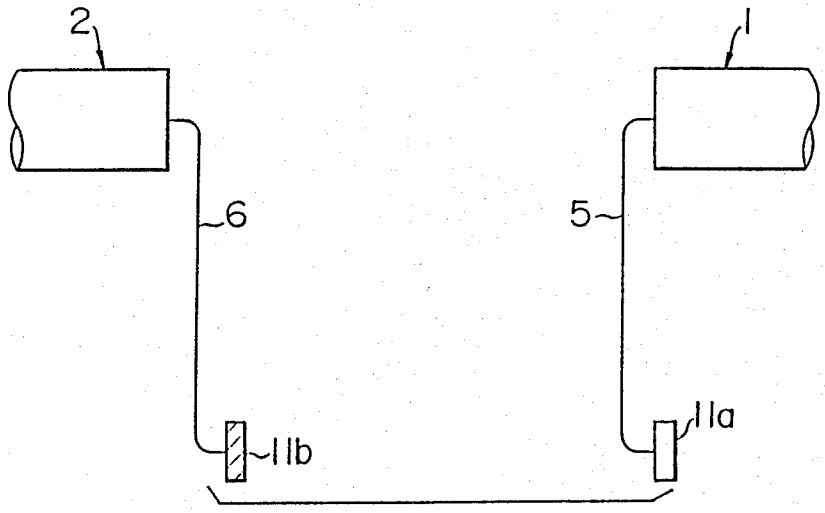
FIG. 2 is an illustration showing the state in which connectors are connected to free ends of the wires.
Figure 3:
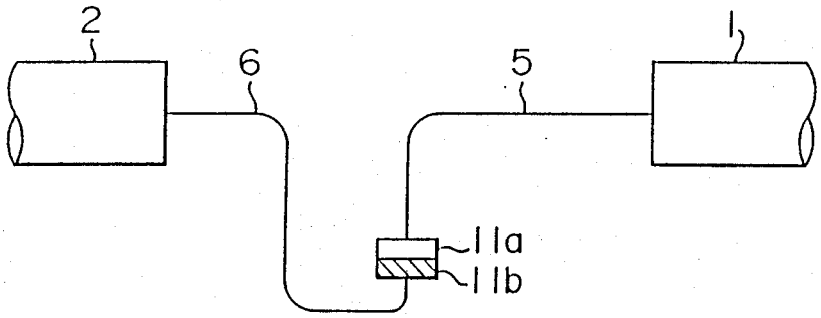
FIG. 3 is an illustration showing the state in which the connectors connected to wires of the two cables are plugged with each other.
Figure 4:
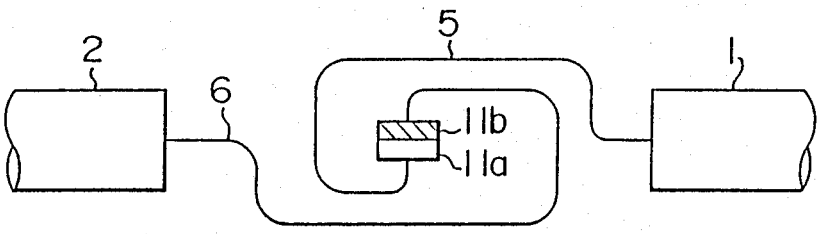
FIG. 4 is an illustration showing the state in which the connectors are rotated 180 degrees and positioned in a proper bank location.
Figure 7:
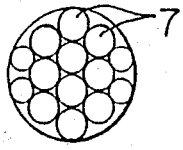
FIG. 7 is an illustration showing the state in which the connectors for all the units in the cable are finally bundled together.
Figure 5:
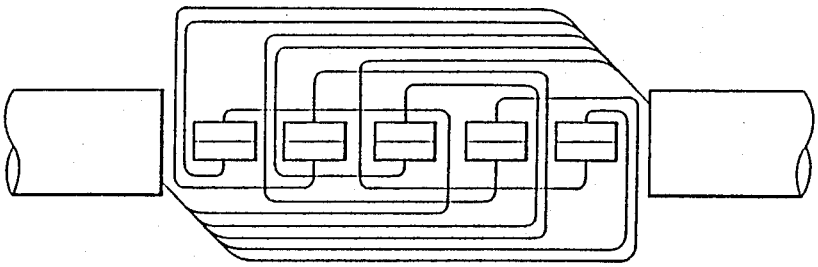
FIG. 5 is an illustration showing the state in which the connectors connected to the wires of a selected unit in the cable are positioned in their proper bank locations.
Figure 6:
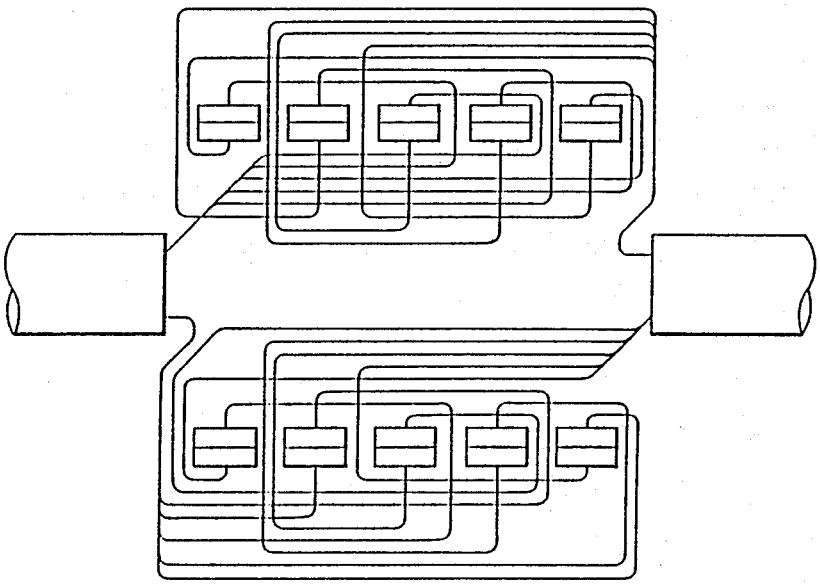
FIG. 6 is an illustration showing the state in which the connectors connected to the wires of each unit in the cable are positioned in their proper bank location.

A connecting device (not shown) for connecting the number of wires 5, 6 to corresponding connectors 11*a*, 11*b* is placed at a position removed about 500 mm, for example, from the center line of the cables and then so operated to connect free ends of the wires 5, 6 to the corresponding connectors 11*a*, 11*b* (see FIG. 2). After all the wires 5, 6 of the cables 1, 2 have been connected to the connectors, the connectors 11a connected to 100 wire pairs of one unit in one cable are plugged with the connectors 11*b* connected to 100 wire pairs of a corresponding unit in the other cable as shown in FIG. 3 (only one wire is shown in the figure for clarity). In case of the connector adapted for 10 wire pairs, 10 connectors are employed for connecting the 100 wire pairs of one selected unit. The connectors 11*a*, 11*b* thus plugged together with each other are rotated 180 degrees and are positioned in a proper bank location as shown in FIG. 4. The illustration affords very graphically a teaching of how orderly the wires in a multi-pair connector can be maintained. Further, as illustrated in FIG. 5, the remaining 9 connectors are positioned in their proper bank locations in a like manner. It is to be noted herein that every two connectors are arranged in one bank location. The 10 connectors thus positioned in respective proper bank locations are bundled together using a string. For the remaining units, the wires are connected similarly by plugging corresponding connectors together with each other, rotating the connectors 180 degrees about an axis perpendicular to the plane of the wire pairs joined to the connectors and positioning them in their proper bank locations, and then binding the connectors by means of strings. After binding the corresponding connectors for all the units of the two cables in this manner, the individual bundles are further bundled using a string (or a tape) as a whole (see FIG. 7).

According to another method of the present invention, in case of employing a new cable as one out of two cables to be spliced, an outer sheath of a predetermined length is removed from the end of the new cable in advance, and connectors are then connected to the wires in a free separate state. The new cable thus prepared is spliced to the other cable in the site as mentioned above. In this case, the amount of operation required at the site is reduced greatly, resulting in the improved operation efficiency.

The present invention has the following effects:

(a) As respective lengths of free separate wires in an existing cable are cut to be of substantially the same length from the end thereof, splicing can be efficiently performed in the site.

(b) The lengths of free separate wires in the cable are sufficient from the end thereof that, bundling of the connectors can be readily and efficiently performed to provide a compact splice bundle.

(c) In case of employing new cables, as the connectors can be previously connected to free wires at the end of the cable in another place such as a factory, the amount of operation to be performed at the site can be reduced to greatly improve the operation efficiency.

I claim:

1. A wiring method using a plurality of connectors, said method comprising the steps of:

preparing two lengths of cables each containing a number of wire pairs:

removing the outer sheaths of the respective cable ends to expose free ends of the wire pairs of a predetermined length;

installing connectors on said free ends of the wire pairs with a plurality of wire pairs in each connector, the connectors installed on one cable end being pluggable with corresponding connectors installed on the other cable end;

plugging said connectors on one cable end together with said connectors on the other cable end;

rotating said connectors 180 degrees and positioning said connectors in their proper bank locations; and bundling said connectors.

2. A wiring method using a plurality of connectors, said method comprising the steps of:

preparing a length of a first cable including exposing free ends of a plurality of wires of a predetermined length having installed thereon a plurality of connectors with a plurality of wires joined to each connector;

removing an outer sheath of a cable end of a second cable to expose free ends of the wires of a predetermined length;

installing a plurality of connectors onto said free ends of the wires with each connector being connected to a plurality of said wires of said second cable, said connectors being pluggable with corresponding connectors installed on the first cable;

plugging the connectors on the two cables together;

rotating the connectors 180 degrees and positioning them in proper bank locations; and bundling the connectors.

* * * * *